US007520326B1

(12) United States Patent
Hill et al.

(10) Patent No.: US 7,520,326 B1
(45) Date of Patent: Apr. 21, 2009

(54) METHOD AND APPARATUS FOR PERFORMING DOWN HOLE SAND AND GRAVEL FRACTURE PACKING OPERATIONS

(76) Inventors: Ron C. Hill, 301 Sugar Trace, Broussard, LA (US) 70518; Darrin T. Patin, 140 Resha Rd., Breaux Bridge, LA (US) 70517

( * ) Notice: Subject to any disclaimer, the term of this patent is extended or adjusted under 35 U.S.C. 154(b) by 496 days.

(21) Appl. No.: 11/053,830

(22) Filed: Feb. 9, 2005

(51) Int. Cl.
*E21B 43/04* (2006.01)
*E21B 34/00* (2006.01)

(52) U.S. Cl. ..... 166/278; 166/51; 166/205; 166/144

(58) Field of Classification Search ..... 166/278, 166/205, 328, 51, 144
See application file for complete search history.

(56) References Cited

U.S. PATENT DOCUMENTS 4,671,361 A * 6/1987 Bolin ..... 166/377
4,915,172 A * 4/1990 Donovan et al. ..... 166/278
4,969,524 A 11/1990 Whiteley
6,364,017 B1 * 4/2002 Stout et al. ..... 166/278
2006/0108115 A1 * 5/2006 Johnson ..... 166/278

* cited by examiner

*Primary Examiner*—Shane Bomar
(74) *Attorney, Agent, or Firm*—Robert N. Montgomery

(57) ABSTRACT

An in-tubing or casing fracture packing assembly including a running tool, HDR sub assembly, a displaceable flow diversion valve by which a filter media slurry is pumped down the annulus of the assembly until a gravel pack is achieved. The HDR running tool allows the bottom hole assembly to be deployed without fear of premature release due to loads or manipulation during deployment, but allows for easy detachment once pumping is completed. An equalizing vent in the HDR sub assembly maintains equal pressure internally and externally. The flow diversion valve is autonomously tripped when the media has been properly placed, providing a positive indication at the surface. A portion of the assembly is removed and the packing assembly remains within the well bore after pumping is completed. An isolation seal is then placed on the sealing mandrel of the assembly and isolated to the tubing or casing wall.

18 Claims, 17 Drawing Sheets

METHOD AND APPARATUS FOR PERFORMING DOWN HOLE SAND AND GRAVEL FRACTURE PACKING OPERATIONS

1. FIELD OF THE INVENTION

This invention relates generally to methods and apparatus used for performing sand and gravel fracture packing operations in oil and gas well operations and more particularly to a method and apparatus to be deployed using a variety of common types of screens and packers and various methods of deployment in a manner that allows autonomous bypass valve operation and fracture packing with a slick-line or the like, thereby eliminating the need for multiple trips down the well with a work string.

2. GENERAL BACKGROUND

The use of gravel pack assemblies and fracture pack assemblies are well known to those skilled within the art and such assemblies are widely used in oil and gas well completion operations.

Fracture packing assemblies are generally used to stimulate well production by using liquids pumped down a well-bore under pressure to fracture the rock formations adjacent to the well-bore. In some operations, such as hydraulic fracturing, these operations utilize various agents suspended within the liquid to keep the formation fractures open, thereby inducing an increase in flow rates of gas or oil from the formation into the well-bore. Gravel pack completion operations are generally used for controlling the sand in unconsolidated reservoirs. Gravel packs may also be used in open-hole completions or inside-casing applications. One example of a typical gravel pack application involves reaming a cavity in the well-bore and then filling the reamed area with loose sand. This process, referred to as gravel pack, provides a consolidated sand layer in the well-bore adjacent the surrounding oil or gas producing formation, thereby restricting sand migration from the formation. A slotted or screen liner is deployed within the formed gravel pack, thereby allowing the oil and gas production fluids to enter the production tubing flowing to the surface while filtering out the surrounding gravel.

A more specialized operation utilizes high-pressure fluids to pack or squeeze the carrier fluid into the formation, thereby placing gravel in perforations of a completed well and into the space around and between the sand screens and the formation.

Fracture packing operations are very similar to the above gravel packing and operation, except the pumping operation is performed using higher pressures and with a denser, viscous fluid in order to fracture rock formations, thus creating perforations and tunnels. Therefore, the down-hole tool assemblies used for the two procedures are generally the same.

Gravel pack or fracture pack assemblies are run into the well-bore on what is referred to as a work string consisting of a length of drill pipe normally removed from the well-bore when the pumping operation is complete. The completion assemblies also contain a setting tool for the packer assembly being used and a crossover or flow diversion valve assembly used to redirect the high-pressure fluids into the formation. Such assemblies generally require a setting ball to be dropped from the surface which must fall to a seat located within the packer assembly, thereby actuating the packer and thus isolating the packer assembly from the upper portion of the well-bore. In some cases, the ball establishes the crossover flow path in the packer as well. Various drawbacks plague this type of operation, such as the ball being lost or damaged, or seat damage and/or debris may also cause seating problems. Further, it takes quite some time for the ball to reach the completion assembly. Most importantly, the setting and crossover tools must be pulled from the well-bore before the seal assembly and production tubing can be run into the well-bore. When the pumping operation is completed, the entire work string is commonly removed from the well and a separate production string, through which the production fluids or gases will flow, is then landed back in the reservoir. Replacement of the work string with the production string takes considerable rig time and adds to the expense of the completion. It is commonly understood that the withdrawal and run in operation exposes the well to fluid losses and often results in formation damage.

A need exists, therefore, for a gravel pack, fracture pack, and like assembly systems that can be run into the well that would eliminate the various problems that plague current systems, greatly increasing the potential successfulness and life of the gravel or fracture pack and saving considerable rig time.

3. SUMMARY OF THE INVENTION

The present invention relates to a method and apparatus that can be used with existing gravel pack, fracture pack, and sand control assemblies. The apparatus can be run into the well-bore on an electric line, wire-line, braided line, slick-line, coiled tubing, or jointed pipe in a work-over or completion operation. The apparatus consists of a unique flow diversion valve placed between a removable High-Density/High rate packer attachment assembly referred to here after simply as a "HDR" packer attachment assembly equipped with an equalizing vent and a production screen assembly, independent of the isolation assembly thereby allowing a variety of packers to be used and/or completion operations to be conducted using the same production screen assembly.

Unlike the prior art, the completion components of the instant invention remain in the well after the pumping procedure is complete. The same components are then used for the production phase. Therefore, the present invention eliminates the need for a separate run with a work string and the retrieval of special tools after packing.

In addition, the completion assembly includes a displaceable check valve actuated automatically by pressure differentials during pumping of the gravel pack. Equalization of these pressure differentials on the displaceable check valve assembly via the HDR assembly with equalizing vent during sand control operations prevents the completion assembly from collapsing during pumping operations.

Pressure differential readings resulting from the displacement of the check valve provide a virtual picture of the filter media placement during pumping operations. The check valve assembly further provides a means of deploying the packing fluids without risk of premature release of conventional bypass valves resulting in better handling and control of the bottom hole packing fluid during pumping thus allowing the bottom hole filter media to be properly placed with more assurance and accuracy.

Still further, the invention allows disposing of sand control media in the annulus circumferentially about the assembly via multiple types of placement operations, thus giving the flexibility to complete any job in any fashion with the same assembly.

Versatility is enhanced by adaptation of the displaceable flow diversion valve assembly and HDR assembly with equalizing vent to any number of completion assemblies, thereby allowing them to be tailored to meet the requirements of each specific well completion. The invention further provides a means for carrying screens into the well, which makes it applicable to unconsolidated formations. The assembly of the present invention is capable of passing through restrictions in the well bore and be placed inside of and around such restrictions during operations, thus giving the completion assembly the ability to be deployed in all types of completions and work-over operations. Utilization of the displaceable check valve allows for gravel pack pumping at high rates and high density, without attachment to a work string. This allows for the installation of an in-tubing fracture pack with mechanical isolation, heretofore unachievable. A centering means is also provided with the assembly for centrally locating the completion assembly inside tubing or casing, thus allowing for circumferential equalization during pumping and isolation operations.

4. BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

Figure 2:
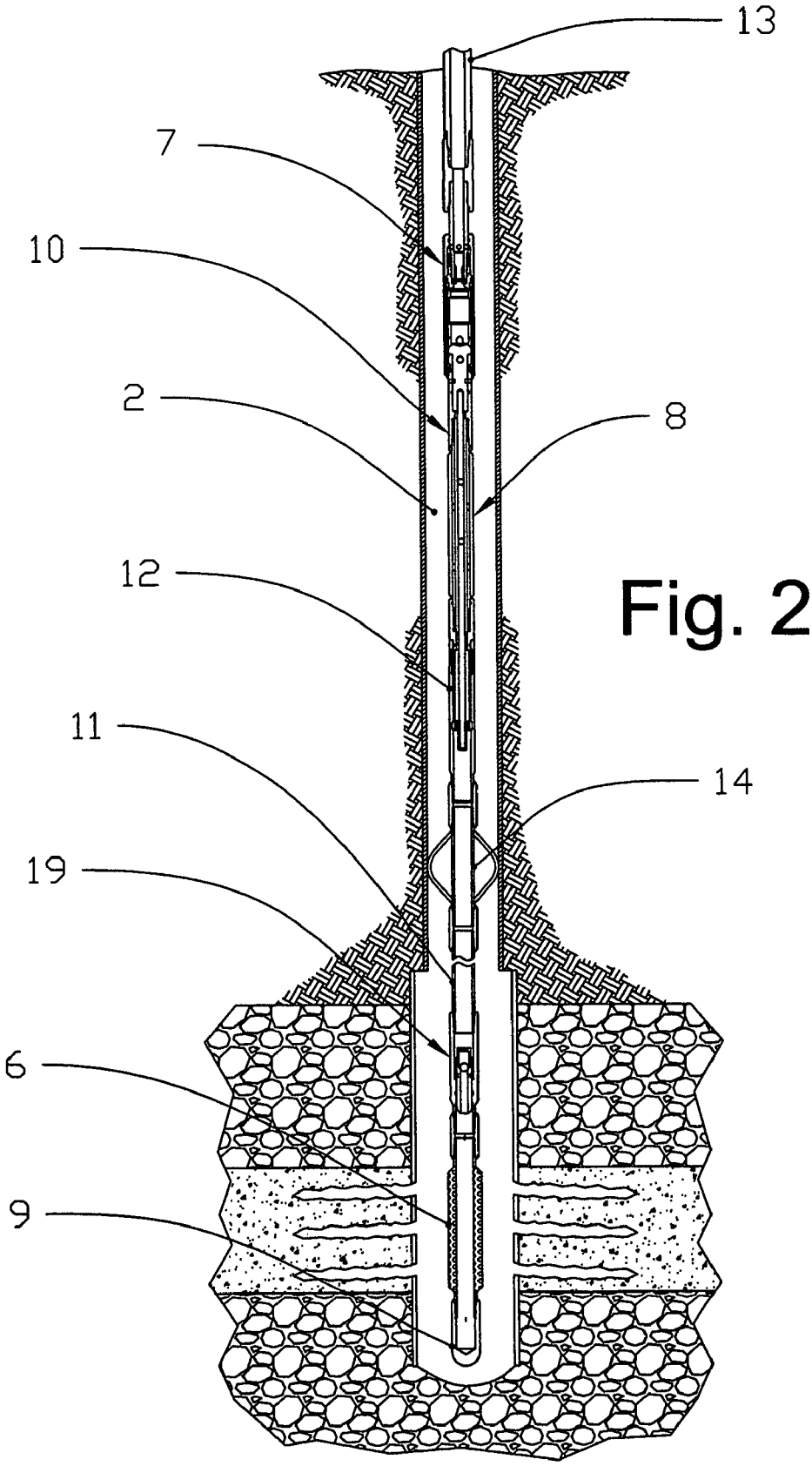
FIG. 2 is a sectional view of the preferred embodiment assemblies of the invention used for gravel pack operations down hole.
Figure 8:
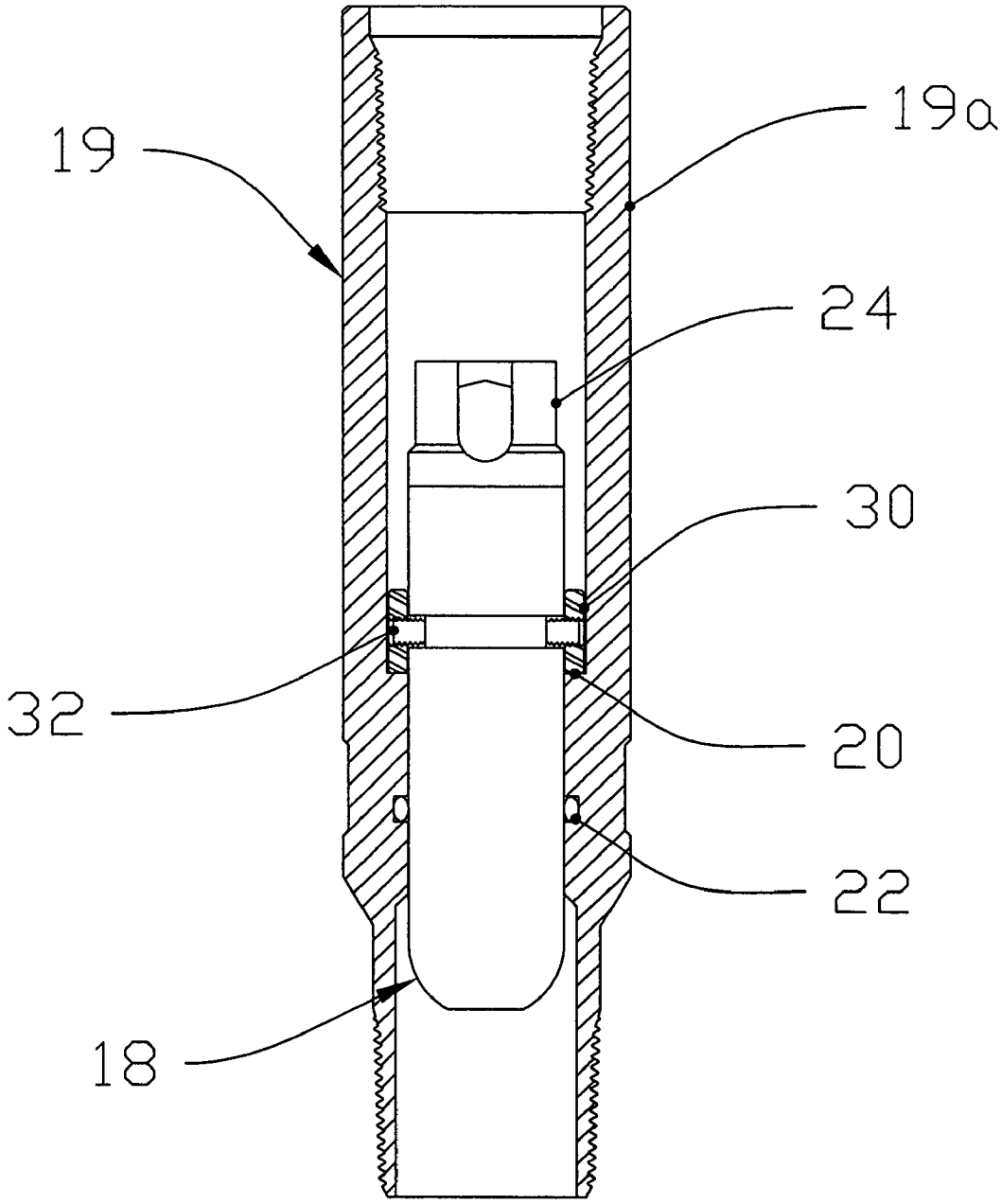
FIG. 8 is a section view of the valve assembly.
Figure 8A:
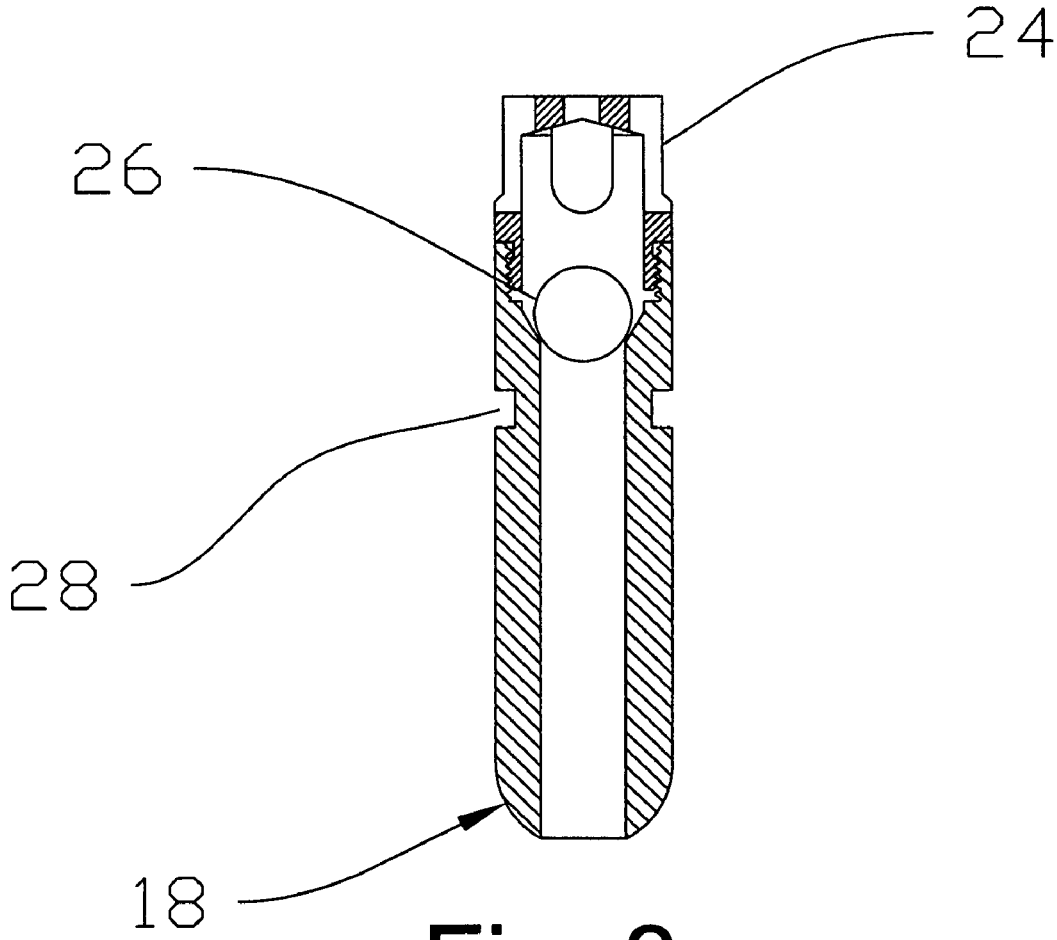
Figure 8B:
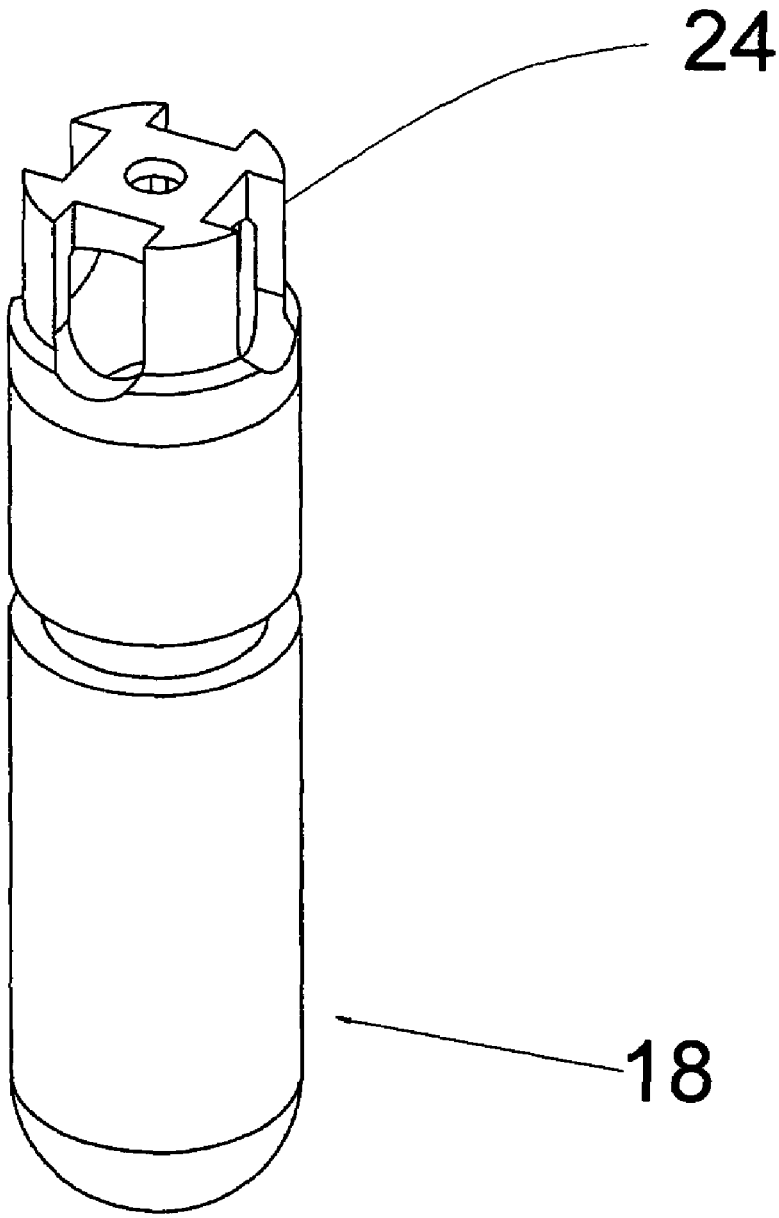
Figure 9:
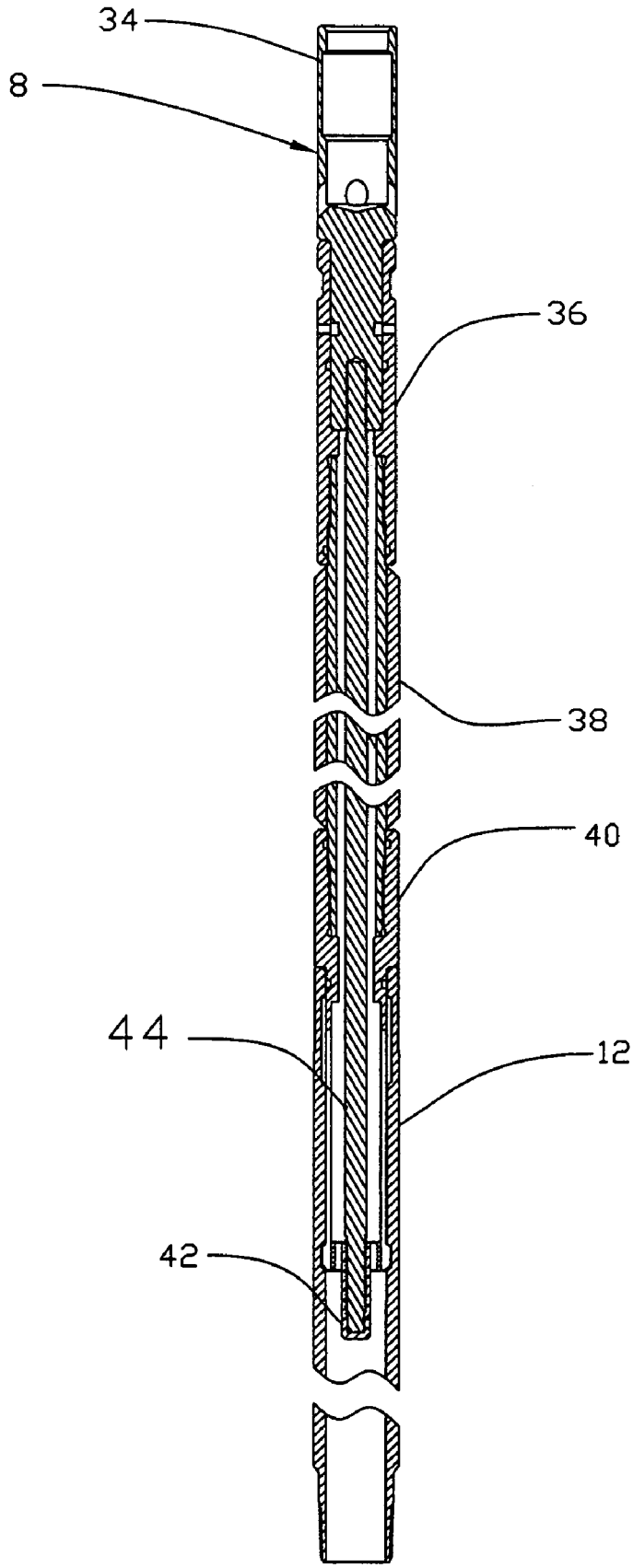
Figure 9A:
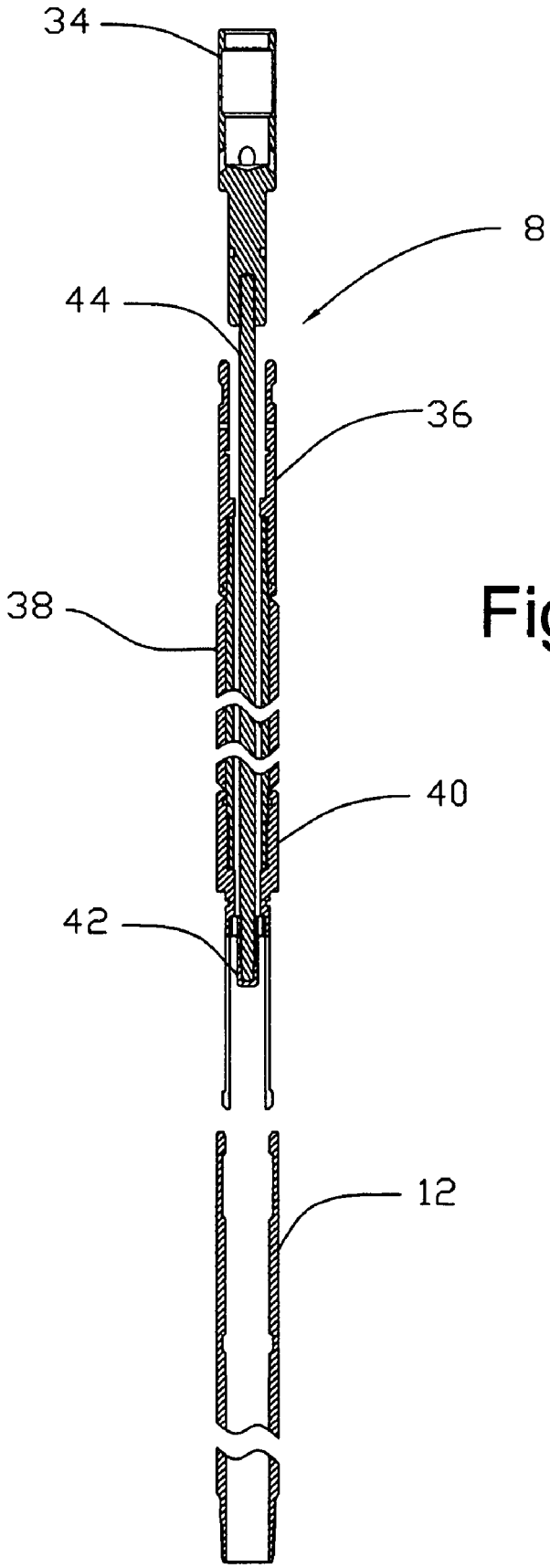
Figure 10:
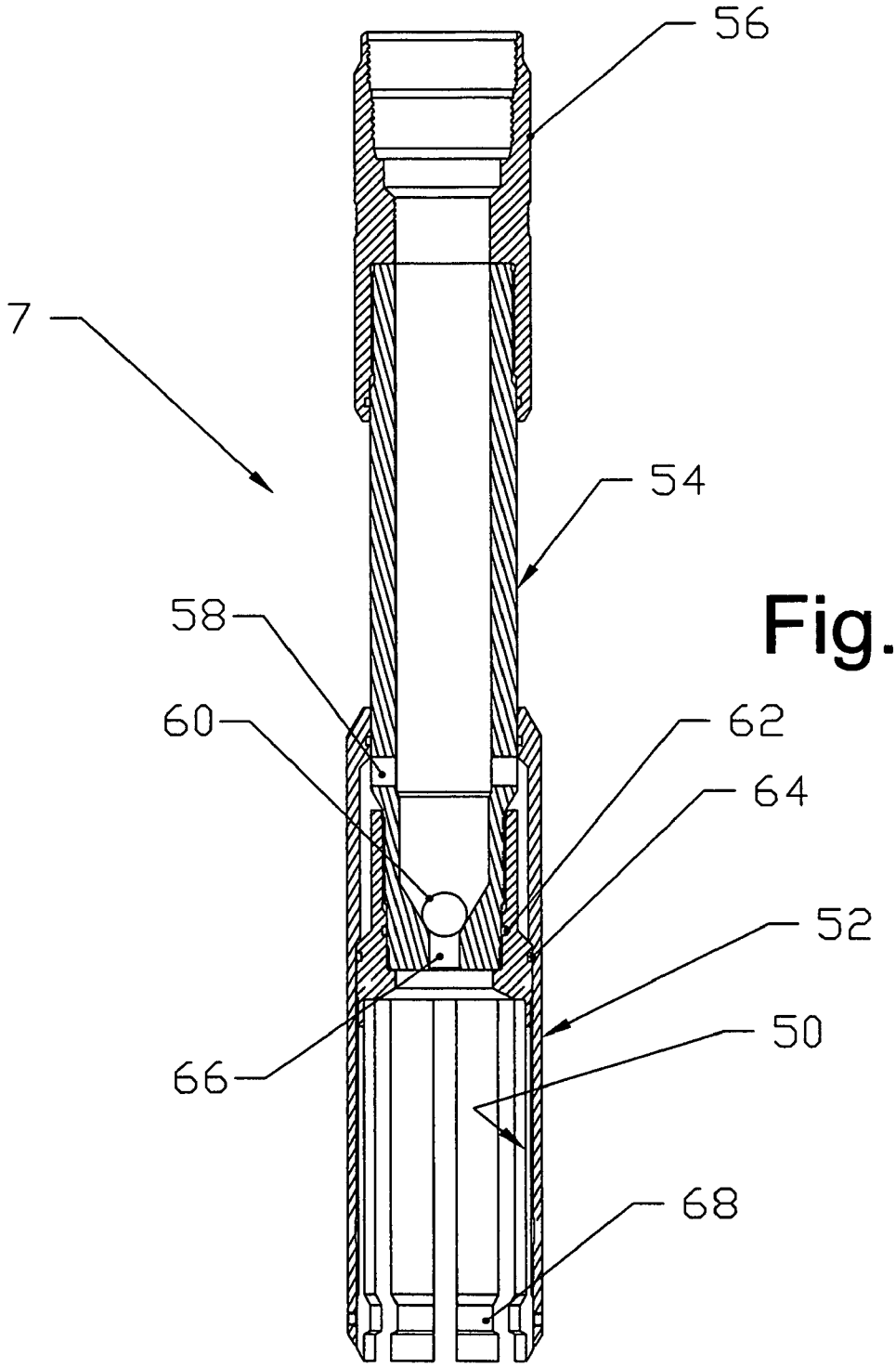
Figure 11:
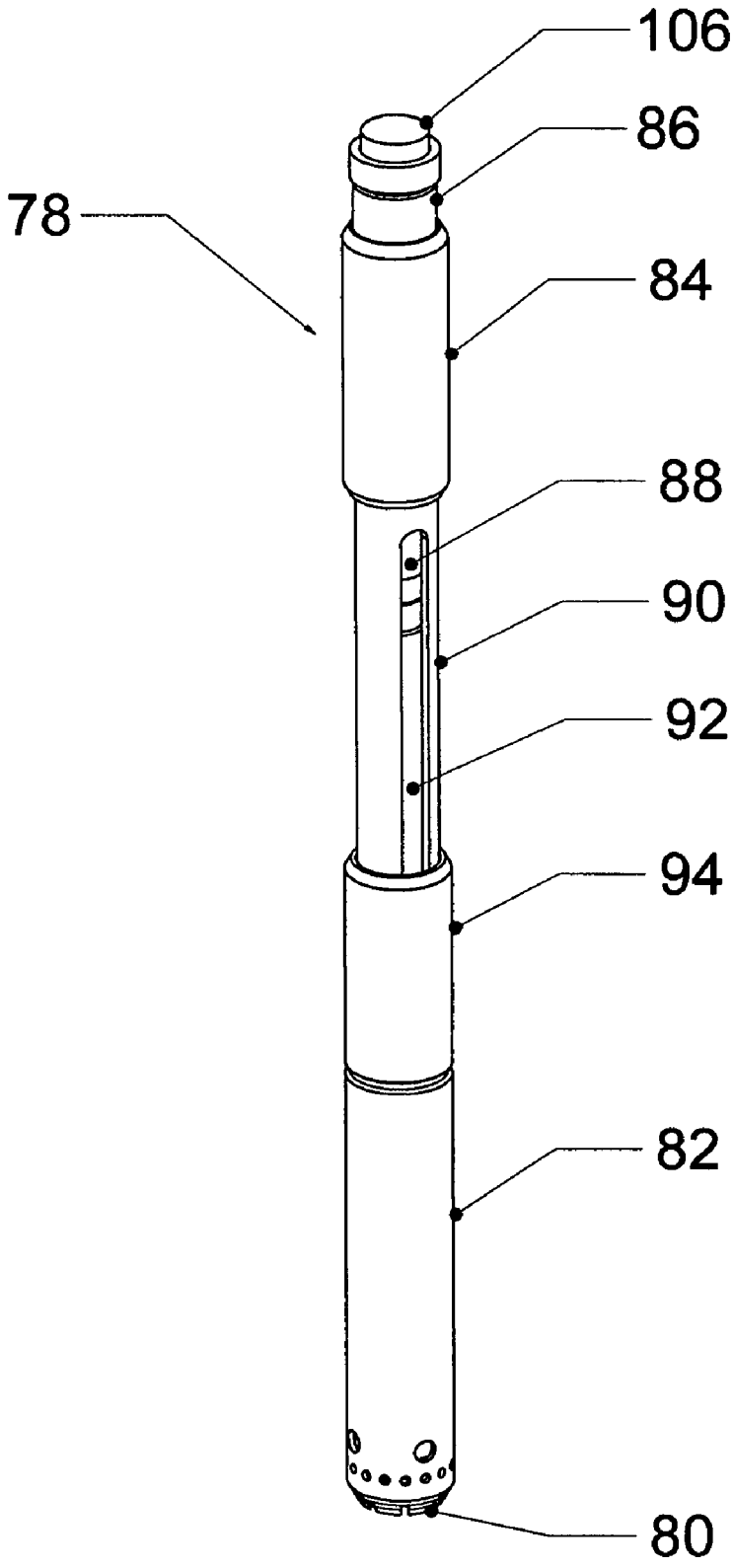
Figure 11A:
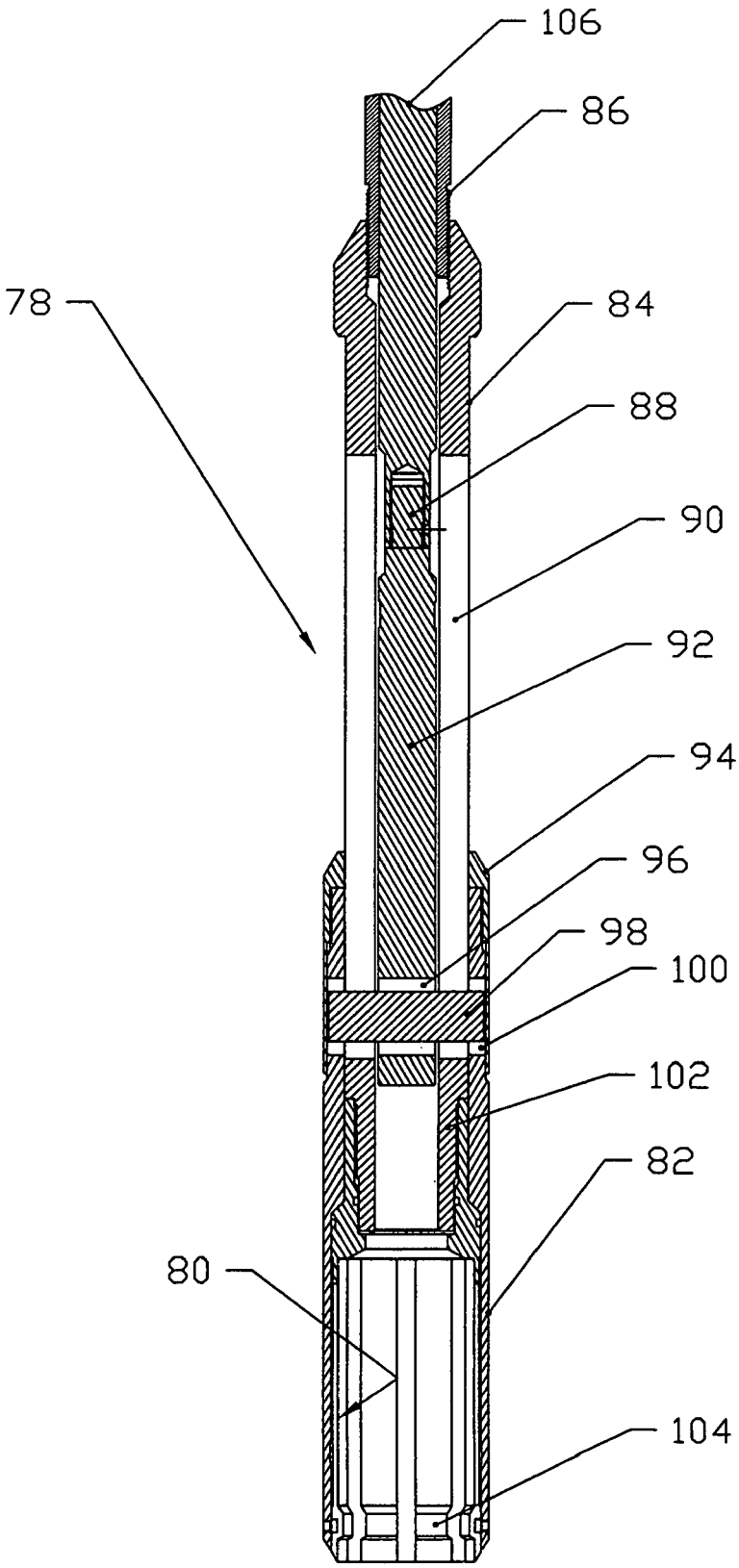
Figure 12:
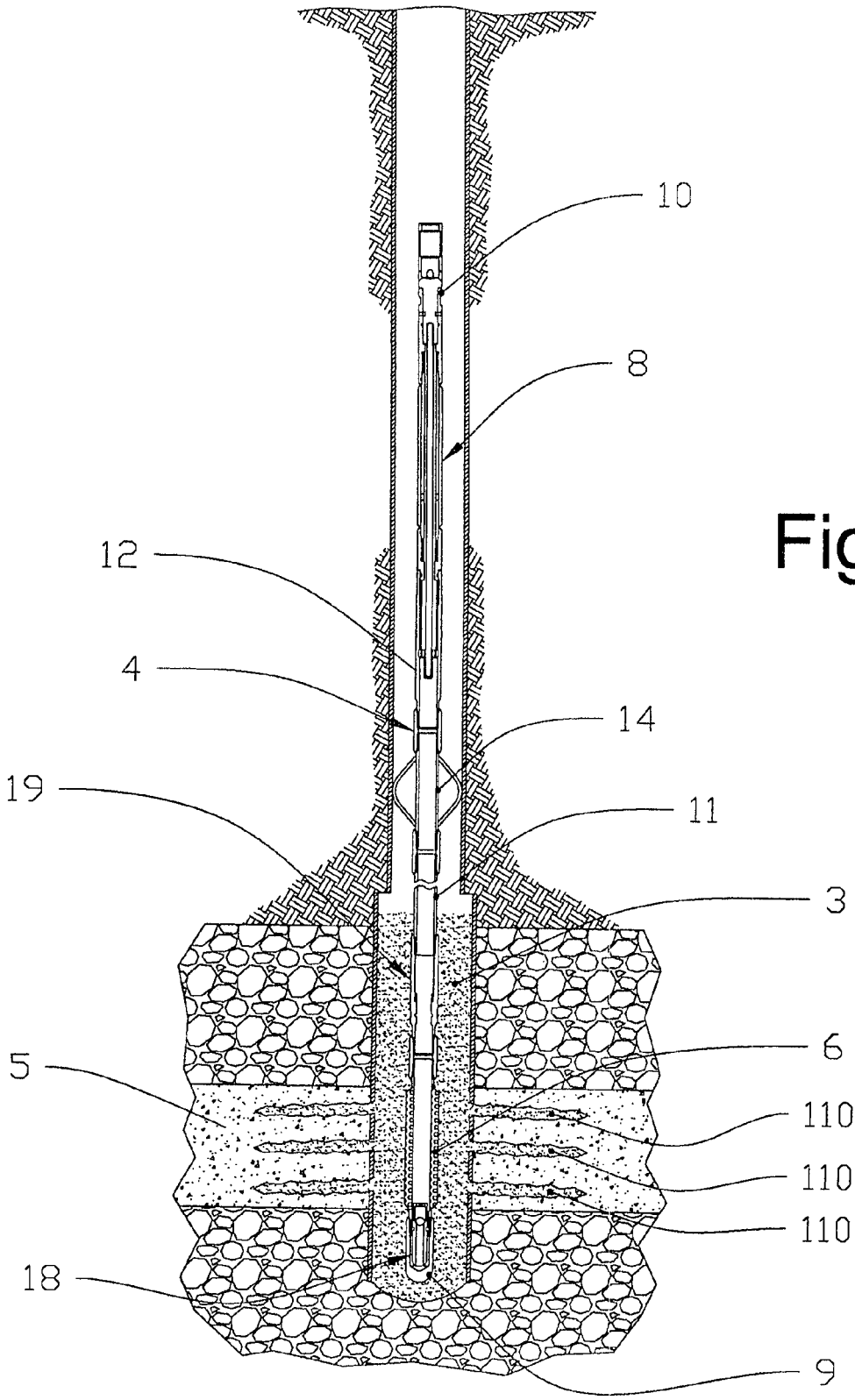
Figure 13:
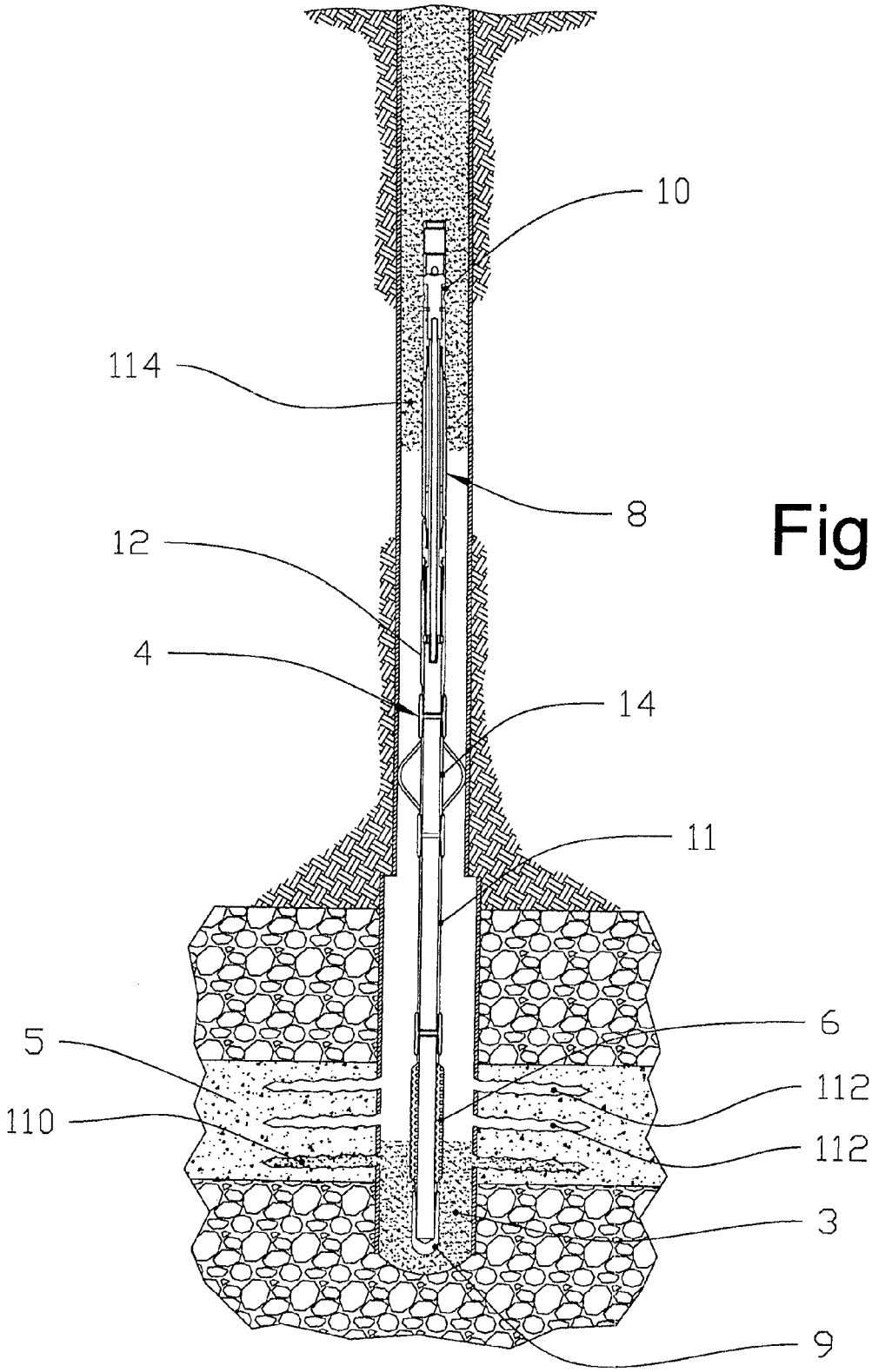

FIG. 8*a* is a section-view of the ball cartridge portion of the valve assembly seen in FIG. 8;

FIG. 8*b* is an isometric view of the ball cartridge portion of the valve assembly in FIG. 8;

FIG. 9 is a section view of the assembled HDR assembly with equalizing vent;

FIG. 9*a* is an expanded section view of the HDR assembly with equalizing vent seen in FIG. 9;

FIG. 10 is a sectional view of the HDR hydraulic running tool seen in FIG. 2;

FIG. 11 is an isometric view of the optional HDR mechanical running tool;

FIG. 11*a* is a cross-sectional view of an optional HDR mechanical running tool seen in FIG. 11;

FIG. 12 is a sectional view of a completed filter media placement operation performed with the preferred embodiment assemblies with displaced valve subassembly; and FIG. 13 is a sectional view of a completed filter media placement operation not performed with the preferred embodiment assemblies.

5. DETAILED DESCRIPTION OF THE PREFERRED EMBODIMENT

Figure 1:
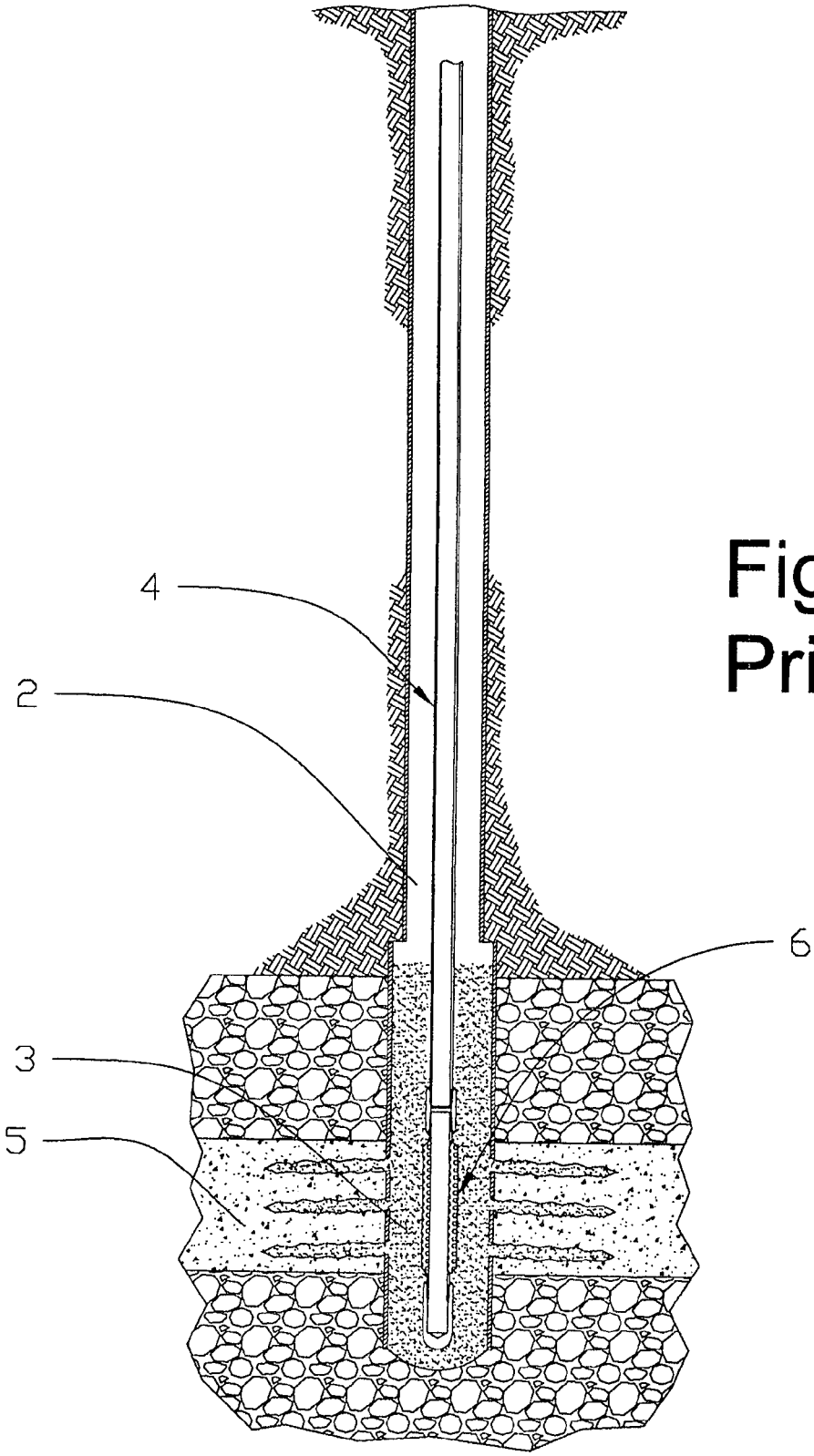
Fig. 1 Prior Art
FIG. 1 is a sectional view of a typical gravel pack operation down hole.

A typical gravel pack completion assembly is illustrated in FIG. 1 showing a perforated well-bore annulus 2, with casing perforations shown extending into a zone of interest 5. A tube 4 is shown located within the well bore annulus 2, attached a screen 6. Gravel 3 is shown packed into the perforations in the zone of interest 5 surrounding the screen 6. The gravel 3 provides an effective filter for formation fluids as a result of the formation sand, flowing with the production fluid being largely trapped in the interstices of the gravel.

Figure 3:
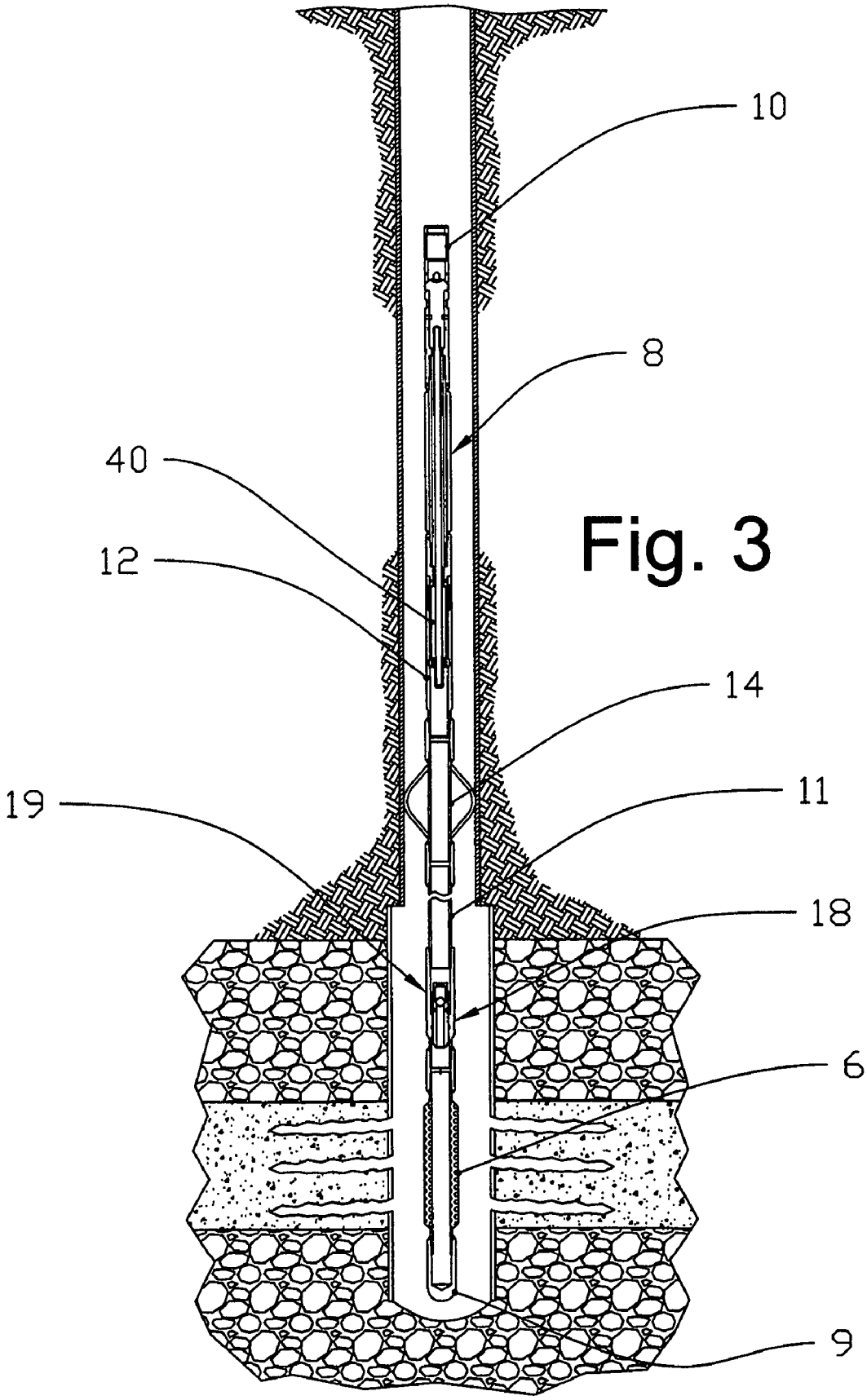
FIG. 3 is sectional view of the preferred embodiment assemblies with running tool disconnected.
Figure 5:
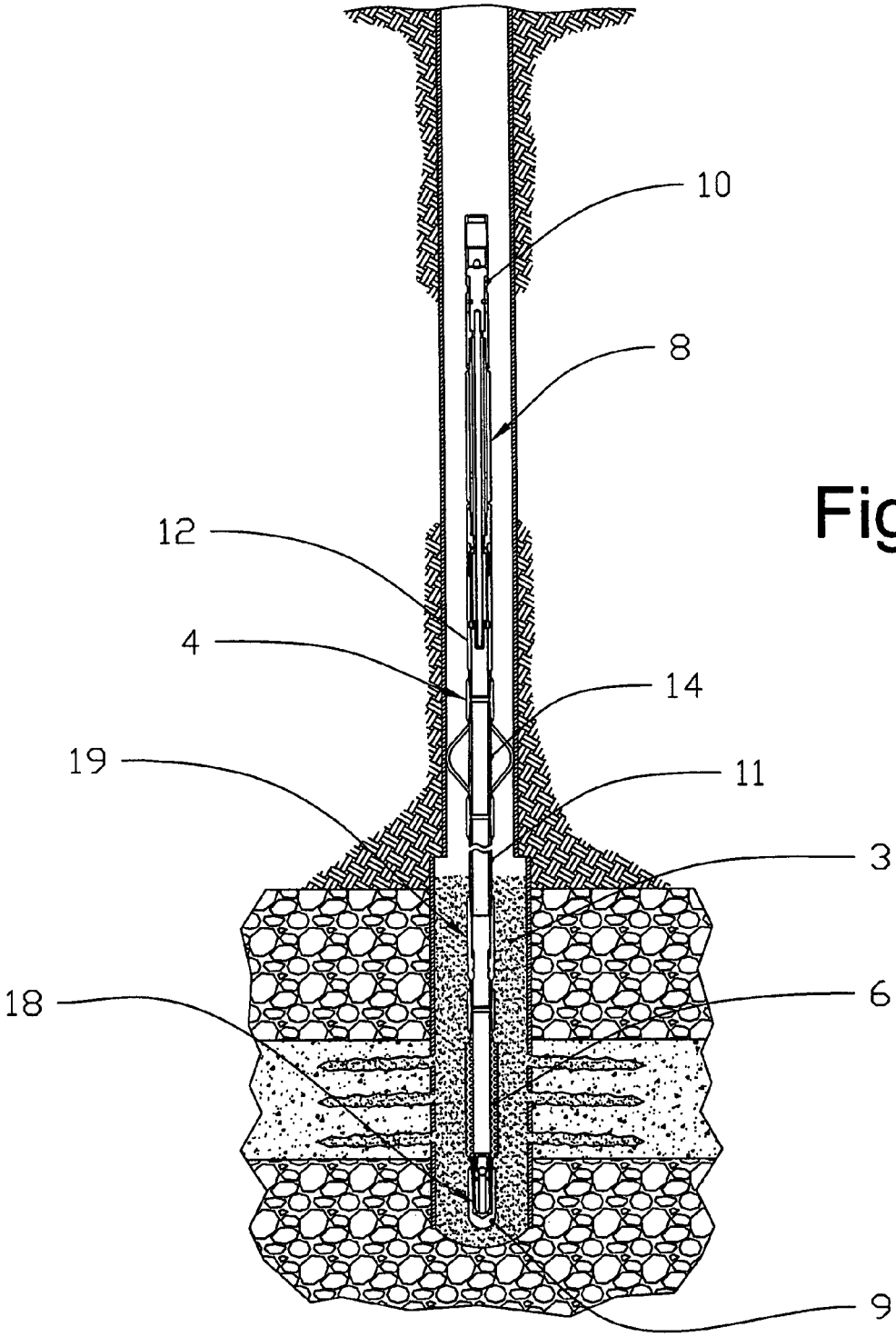
FIG. 5 is a sectional view of the preferred embodiment assemblies with displaced valve assembly.
Figure 6:
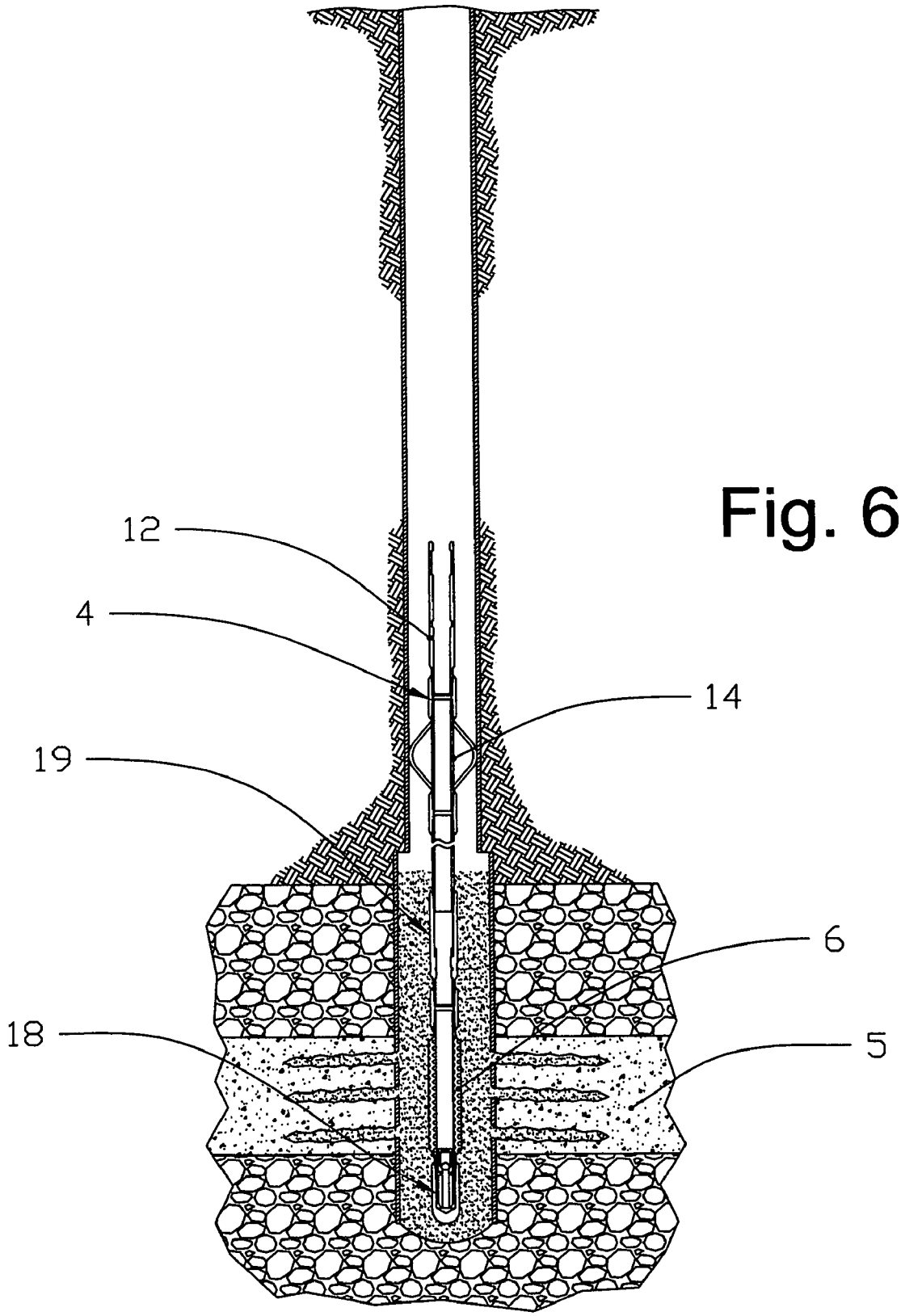
FIG. 6 is a sectional view of the preferred embodiment assemblies with HDR assembly removed.
Figure 7:
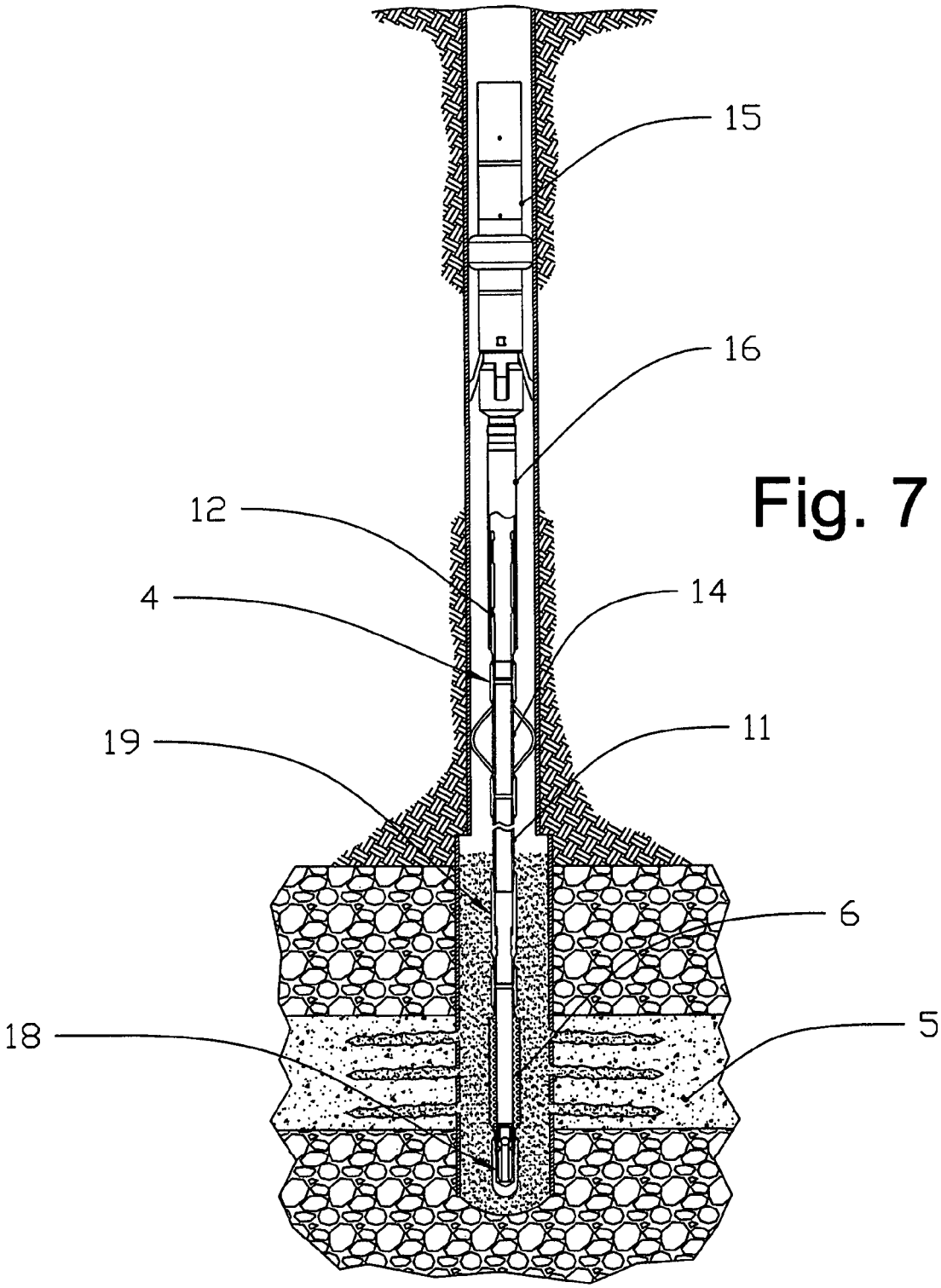
FIG. 7 is a sectional view of the preferred embodiment assemblies with pack-off and overshot assemblies attached.

As first seen In FIG. 2 the present invention includes an adaptive completion assembly 10 that includes a production screen portion that includes a bull plug 9, a production screen assembly 6, a centralizing assembly 14, a displaceable flow diversion valve assembly 19, a blank pipe 11, and a sealing mandrel 12, coupled to a removable HDR sub assembly having a pressure equalizing vent screen assembly 8, all of which are confined diametrically to that of the tubing being used for placing the completion assembly 4 seen in FIG. 1, thus allowing the combined assemblies to pass through various casing restrictions. The flow diversion valve assembly 19 is a common sub-section of threaded pipe 19*a* having an internal landing shoulder 20 and an o-ring groove 22 for supporting a removable insert member 18 having a movable ball 26 therein and a cage 24 attached as seen in more detail in FIG. 8 and FIG. 8*a*. The flow diversion valve assembly 19 further includes a collar 30 supported by the landing shoulder 20 within the sub-section 19*a*. In operation the insert 18 is displaced by pressure acting on the insert 18 in a manner that shears pins 32 located between the insert 18 and the shearable collar 30 retained by groove 28, thereby allowing the insert 18, including floatation ball 26, and cage 24 to be displaced from the sub-section 19*a* and deposited within the ball plug 9. The HDR sub assembly 8 including equalizing vent 38 further comprises collets 40 seen assembled in FIG. 9 that enable its attachment to a sealing mandrel 12 as shown in FIG. 3. The assembly further includes a displaceable donut 42 that supports the collets 40 in equalizing vent 38 and a release sub 36 that enables attachment of the HDR vent screen assembly 8 to the HDR running tool 7 seen in FIG. 2 and a top sub 34 attached to the displaceable donut 42 via a rod 44 as shown exploded in FIG. 9*a*. The HDR equalizing vent screen assembly 8 with equalizing vent 38, along with the sealing mandrel 12, threaded to the blank pipe 11, centralizer 14, etc., as seen in FIG. 2, is carried down hole by the HDR running tool 7. Once the assembly is at a desired depth, the HDR running tool 7 is actuated, releasing the HDR assembly 10 that includes the equalizing vent portion and the production screen portion as shown in (FIG. 3). The pumping operation is performed whereby the well is washed and a media is pumped into the well formation around the production screen 6 and into fractures within the well formation until a pressure differential exist on the equalizing vent 38 when venting occurs pressure within the production screen valve assembly 19 displaces the valve assembly as seen in (FIG. 4 & FIG. 5) for relocation within the bull plug 9. After any necessary washing is performed, a pulling tool is run down to the HDR assembly 10. Latching onto the top sub 34 of the HDR assembly and pulling out of the hole removes the HDR equalizing vent screen portion with equalizing vent 8, leaving the sealing mandrel 12 and the production screen assembly 6, 12, 14, 18 and 19 as shown in (FIG. 6). Next, a mechanical or inflatable packer or pack-off assembly with a sealing overshot or stinger connected there below, is run down and seals off within the sealing mandrel 12 (FIG. 7).

Please reference FIG. 9 (the HDR assembly with equalizing vent 8 and sealing mandrel 12 attached). Note the top sub 34 is attached to the rod 44 which is attached to the donut 42. The donut maintains the position of the collet 40 which controls the attachment of the sealing mandrel 12. When the top sub 34 is "pulled", the rod 44 and donut 42 are also pulled. The upward movement of the donut 42 de-supports the collet 40, which allows detachment of the sealing mandrel 12. Once the donut 42 contacts the internal shoulder of the collet 40, the upward pull is carried through the top sub 34, rod 44, and donut 42, and the HDR assembly with equalizing vent 8 can be released from and "dropped off" the sealing mandrel 12.

The HDR running tool 7, as seen in detail in FIG. 10, allows high weight bottom hole assemblies to be deployed without fear of premature release due to loads or manipulation during deployment, yet allows easy removal of the HDR assembly with equalizing vent 8 once pumping operations are complete. The hydraulic running tool 7 includes collets 50 having an internal upset portion 68 for cooperative engagement with the HDR assembly 10, collets housing 52, a control mandrel 54 having multiple ports 58 slidably attached to the collets housing 52, a top sub member 56 threadably attached to one end of the control mandrel, and a check ball 60 located at the mouth of I.D. port 66 within the control mandrel 54. O-rings 62 and 64 provide fluid sealing for the control mandrel and collets 54 and 50.

The mechanical running tool 78 seen in FIG. 11 is an optional replacement for the hydraulic running tool 7. This mechanical running tool still includes collets 80 having an internal upset 104 and a collets housing 82, but has a modified control mandrel 84 that includes a slot 90 extending clear through the mandrel walls extending over the intermediate length of the mandrel between the setting tool 86 end and the connection end 102. An adapter member 92 is connected via threaded member 88 to the setting tool inner rod 106. In this case a cover sleeve 94 is provided at the upper end of the collets housing to insure a snug fit around the sliding mandrel 84. Flexibility is provided for the mandrel 84 by providing a transverse slot 96 in the control mandrel 84 adjacent the connection end 102 and the adapter 92. A slot 100 is also provided in the collets housing cooperative with the slot in the control mandrel 84 for the insertion of a bar 98 passing through the collets housing 82, the control mandrel 84 and the adapter 92.

Figure 4:
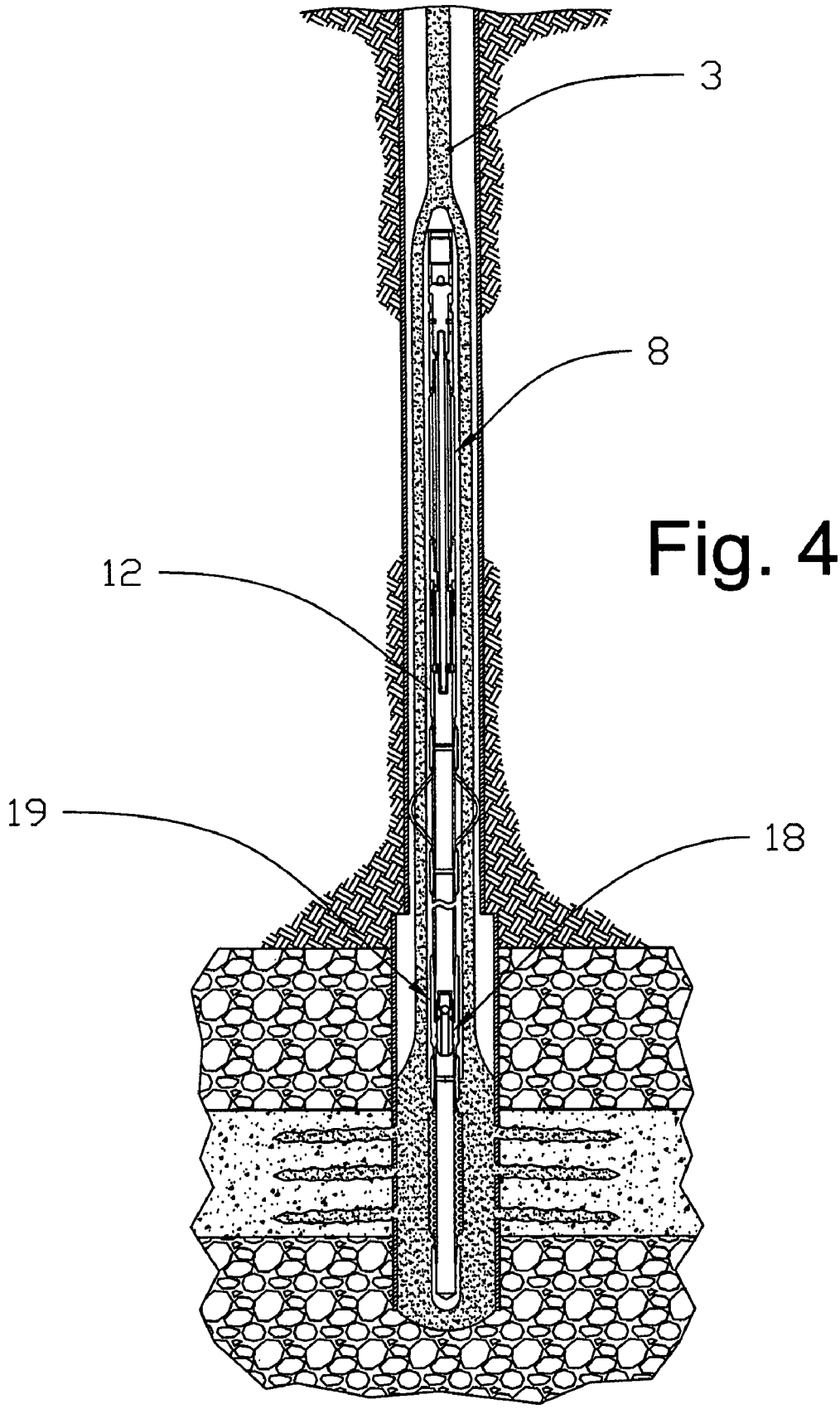
FIG. 4 is a sectional view of the preferred embodiment assemblies with slurry being applied down hole.

In operation the completion assembly 4, seen in FIG. 1, can be completed using a wide variety of screens and packers generally available in all popular production tubing sizes and materials. The assembly 10, seen in FIG. 3, including the displaceable flow diversion valve assembly 19 and HDR assembly 10 with ITS equalizing vent 8 may be deployed in a single trip into the well-bore annulus 2 on coiled tubing and the isolation operation completed in subsequent trips on slick-line or the like. The displaceable flow diversion valve assembly 19 included in the HDR assembly with equalizing vent 8 allows a completion assembly 4 to be completed at a higher than normal pressure rate with high density gravel slurry 3 pumped from the surface, as shown in FIG. 4, while providing a highly dependable mechanical isolation of the annulus 2 when completed. The following steps are used to deploy and complete in an area of interest 5 in the well-bore 2. A well bore contaminated with sand and debris is first cleaned in preparation of setting a completion assembly. An assembly 10 with the displaceable flow diversion valve assembly 19 and HDR assembly with equalizing vent 8 is installed within the cleaned well-bore using coil tubing or other conventional well tool carrying operation from the surface in anticipation of the pumping operation, as seen in FIG. 3. Tool carrying operations may include wire-line, slick-line, electric-line, braided-line, coiled tubing unit or snubbing unit or jointed pipe from the drilling rig. Positioning of the assembly 10 may be accomplished using a variety of tools, such as a mechanical, hydraulic or electric, collar, nipple, or tubing end locator, as well as gamma ray log or pulse neutron log. Conveying gravel or other filter media 3 from the surface down the well bore, such as by pumping the media 3 in slurry though the jointed pipe or coil tubing 4, as seen in FIG. 1. The flow diversion valve 19 may also be a displaceable check valve, pump out plug, relief valve, rupture disc, dump valve or pressure release valve. In any case, the media slurry 3 is pumped around the assembly 10 in the manner shown in FIG. 4 and into the zone of interest 5 until the HDR assembly with equalizing vent 8 located within the assembly 10 equalizes pressure in the assembly 10, thereby preventing collapse of the blank pipe 11. The flow diversion valve 19 diverts all flow during pumping operations down the annulus of the completion assembly 4 until sufficient slurry is placed in the annulus of the well bore around the assembly 10. When gravel in the annulus around the completion assembly 4 exceeds the level of the flow diversion valve 19, pressure on the ball 26 shears the pins 32 seen in FIG. 8*a*, thereby allowing the insert 18 to be displaced to the lower portion of the completion assembly 4, within the bull plug 9 as seen in FIG. 5.

FIG. 12 illustrates a completed filter media placement operation performed with the preferred embodiment assemblies with displaced valve subassembly. The filter media 3 has been placed completely across the production screen 6 and the zone of interest 5, and the perforation tunnels 110 have been completely packed. The displaceable flow diversion valve insert 18 has been displaced from the flow diversion valve assembly 19 to the lower portion of the completion assembly 4 within the bull plug 9, leaving a clear full bore in the completion assembly 4 for later production operations. The HDR assembly with equalizing vent 8 portion of the assembly 10 would next be removed using conventional fishing methods. The well bore, as seen in FIG. 6, is now ready for sealing and can be sealed using any borehole sealing method, including but not limited to mechanical or inflatable packers or pack-offs 15, along with sealing over-shots or stingers 16, as shown in FIG. 7, when connecting production tubing to the sealing mandrel 12 of the completion assembly 4 remaining within the well-bore after the pumping operation was completed having been performed with the preferred embodiment assemblies.

FIG. 13 depicts a completed filter media placement operation which was not performed with the preferred embodiment assemblies. During the filter media 3 pumping operation, a pressure differential was created within the completion assembly 4. This condition caused a premature bridge 114 of filter media to form across the equalizing vent 8. Neither the zone of interest 5 nor the production screen 6 were completely covered and packed with filter media 3. Only lower perforation tunnels 110 were packed, leaving empty perforation tunnels 112 and the upper section of the zone of interest 5 uncovered and unpacked. A void between the filter media 3 and the bridge 114 exists which greatly decreases the successfulness and life of the down hole gravel or fracture pack.

Displacement of the insert 18 leaves a clear full bore in the completion assembly 4 for later production operations. Conventional fishing methods using slick-line, e-line or coil tubing then removes the HDR assembly with equalizing vent 8 portion of the assembly 10. The well bore, as seen in FIG. 6, is now ready for sealing and can be sealed using any borehole sealing method, including but not limited to mechanical or inflatable packers or pack-offs 15, along with sealing over-shots or stingers 16, as shown in FIG. 7, when connecting production tubing to the sealing mandrel 12 of the completion assembly 4 remaining within the well-bore after the pumping operation is completed.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A down hole high density/high rate (HDR) completion tool assembly for use with fracture packing assemblies comprising:

a) a tubular assembly having a production screen assembly including a bull plug attached at one end;

b) a section of blank pipe and a centralizing sub joint attached to a flow diversion valve assembly; and c) a sealing mandrel attached to the centralizing sub joint;

d) a equalizing vent assembly located above said production screen assembly detachable from said sealing mandrel; and e) a flow diversion valve assembly located between said production screen assembly and said retrievable equalizing vent assembly having a displaceable float insert assembly having a captured float therein said float insert assembly displaceable from said valve assembly to within said bull plug.

2. The down hole high density/high rate (HDR) completion tool assembly according to claim 1 wherein said flow diversion valve assembly comprises:

a) a tubular subsection having an internal landing shoulder and o-ring; and b) a removable tubular insert member open at one end and having a removable cage member at the opposite end the tubular insert slideably located within said tubular subsection said float located within the tubular insert member captured by the removable cage member; and a collar assembly attached to the tubular insert member by shear pins.

3. The down hole high density/high rate (HDR) completion tool-assembly according to claim 2 wherein said tubular insert member is supported within the tubular subsection by the collar assembly in contact with the landing shoulder located within the tubular subsection.

4. The down hole high density/high rate (HDR) completion tool assembly according to claim 1 wherein said retrievable equalizing vent assembly comprises:

a) a top sub coupling;

b) a rod member attached at one end to the top sub coupling;

c) a releasable sub section housing the rod member slidable upon a portion of the top sub coupling;

d) a vent section attached at one end to the releasable sub section housing;

e) a colleted member attached to the vent section having a displaceable donut member located therein slidably upon an end of the rod member opposite the top sub; and f) a sealing mandrel having means at one end for connecting to the colleted member and a threaded coupling means at the opposite end.

5. The down hole high density/high rate (HDR) completion tool assembly according to claim 4 wherein said displaceable donut provides support for the colleted member.

6. A down hole high density and high rate (HDR) completion tool assembly comprising:

a) a bull plug;

b) a production sand screen assembly attached to the bull plug;

c) a flow diversion valve assembly having a displaceable float insert assembly displaceable between said valve assembly and said bull plug said flow diversion valve assembly attached to an end of the production sand screen assembly opposite said bull plug;

d) a section of blank pipe attached to the flow diversion valve assembly;

e) a centralizing assembly attached to the section of blank pipe;

f) a sealing mandrel attached to said centralizer;

g) a venting assembly having collet means at one end and a retrieving means at the opposite end, and an equalizing vent screen portion detachably attached to the sealing mandrel with said collet means; and h) a HDR running tool connected to the e venting assembly by said retrieving means.

7. The down hole high density/high rate (HDR) completion tool assembly according to claim 6 wherein said flow diversion valve assembly further comprises:

a) a tubular subsection having an internal landing shoulder and o-ring;

b) a removable tubular insert member open at one end and having a removable cage member at the opposite end the insert slidably located within said tubular subsection;

c) a float located within the tubular insert member captured by the removable cage member; and d) a collar assembly attached to the tubular insert member by shear pins.

8. The down hole fracture high density/high rate (HDR) completion tool assembly according to claim 7 wherein said tubular insert member is supported within the tubular subsection by the collar assembly in contact with the landing shoulder located within the tubular subsection.

9. The down hole high density/high rate (HDR) completion tool assembly according to claim 6 wherein said HDR sub assembly further comprises:

a) a top sub coupling b) a rod member attached at one end to the top sub coupling;

c) a releasable sub section housing the rod and slidable upon a portion of the top sub coupling;

d) an equalizing vent section attached at one end to the releasable sub section housing;

e) a colleted member attached to said equalizing vent section having said displaceable donut member located therein slidable upon an end of the rod opposite the top sub; and f) a sealing mandrel having means at one end for connecting to the colleted member and threaded coupling means at the opposite end.

10. The down hole high density/high rate (HDR) completion tool assembly according to claim 6 wherein said HDR running tool further comprises:

a) a tubular control mandrel having a threaded coupling at one end, release ports and a ball check assembly at the opposite end;

b) a colleted member attached to the control mandrel adjacent the ball check assembly; and c) a housing slidable upon the control mandrel surrounding the colleted member.

11. A method for locating, setting, and deploying a down hole high density/high rate (HDR) completion tool assembly for gravel packing operations in a well-bore comprising the steps of:

a) assembling a gravel packing tool string comprising:

i) a tubular assembly having a production assembly including a bull plug attached at one end;

ii) an equalizing vent assembly;

iii) an autonomous displaceable flow diversion valve assembly having an insert assembly displaceable from said diversion valve assembly to within said bull plug said valve assembly placed in between the production screen assembly and the equalizing vent assembly;

iv) a section of blank pipe and a centralizing sub joint attached to the flow diversion valve assembly; and v) a detachable HDR sub assembly attached to the centralizing sub joint;

b) locating the gravel packing tool string assembly within a well-bore at a point of interest;

c) conveying a gravel slurry down-hole to the gravel packing tool string assembly until pressure within the displaceable flow diversion valve assembly increases sufficiently to displace said insert portion of the diversion valve assembly and pressure within the section of blank pipe is equalized;

d) removing the detachable HDR sub assembly from the gravel packing tool string assembly; and e) attaching a well-bore sealing means to said gravel packing tool string assembly.

12. The method according to claim 11 wherein displacement of the insert portion of the diversion valve assembly provides an unobstructed annular path through said displaceable flow diversion valve into the screen assembly.

13. The method according to claim 11 further including the steps of establishing a seal within the well bore above the centralizing sub joint after packing operations are complete and removing the equalizing vent portion, after fracture packing and before packer sealing operations thereby leaving the sealing mandrel, centralizing sub section of blank pipe and the production screen assembly in place within the well bore.

14. The method according to claim 11 further comprising the step of utilizing an HDR running tool to place the gravel pack assembly and remove the HDR equalizing vent sub assembly, the running tool comprising, a tubular control mandrel having a threaded coupling at one end, release ports, and a ball check assembly at the opposite end, a colleted member attached to the control mandrel adjacent the ball check assembly, and a housing slidable upon the control mandrel surrounding the colleted member.

15. The method according to claim 11 further comprising the step of utilizing an HDR e-line running tool to place the gravel pack assembly and remove the HDR equalizing vent sub assembly, the HDR e-line running tool comprising a rod housing having a sliding rod located therein, a control mandrel having an intermediate transverse slotted portion threadably connected externally to the housing at one end and having a threaded connecting portion at the opposite end, an adapter member having a transverse slot connected to the sliding rod slidable within said control mandrel, a traversing pin extending though the transverse slot in the adapter member and through the transverse slotted portion in the control mandrel, a colleted member threadably connected to the threaded conning portion of the control mandrel, a housing slidable upon the control mandrel surrounding the colleted member, and a cover sleeve slidable upon the control mandrel attached to the housing surrounding the colleted member for covering and retaining the traversing pin.

16. A method for locating, setting, and deploying a down hole high density/high rate (HDR) completion tool assembly for gravel packing operations—in a well-bore comprising the steps of:

a) placing a high density and high rate completion setting and placement tool assembly, comprising a retrievable HDR assembly having an equalizing vent screen portion and a production screen portion having seal mandrel section, and a flow diversion valve assembly having a displaceable float insert attached thereto located between said production screen assembly and said HDR assembly, on location within a zone of interest within a well bore;

b) conveying a filter media from the surface down the well bore;

c) surrounding the high density and high rate completion assembly and filling fractured areas within the zone;

d) displacing said displaceable float insert assembly from within said flow diversion valve and thus relocating the float insert assembly to the opposite end of the production screen assembly, thereby establishing an unobstructed full bore flow though the production screen assembly;

e) detaching the equalizing vent screen portion of the HDR assembly from the sealing mandrel and removing it from the well bore; and f) attaching a sealing overshot and pack-off assembly to the seal mandrel for production.

17. The method according to claim 16 further includes the step of leaving the production screen portion of the HDR assembly, comprising the sealing mandrel, centralizer sub, the flow diversion valve assembly with displaced float insert, production screen and bull plug within the well bore, after placing the filter media for use in production operations upon removal of the equalizing vent screen assembly.

18. The method according to claim 17 further includes the step of attaching an isolation assembly to the sealing mandrel.

* * * * *